US005232008A

United States Patent [19]

Jeffress et al.

[11] Patent Number: 5,232,008

[45] Date of Patent: Aug. 3, 1993

[54] TWO HANDLE FAUCET AND MOUNTING STRUCTURE THEREFOR

[75] Inventors: Ronald E. Jeffress, Avon Lake; Roy W. Burns; Richard D. Clift, both of Elyria, all of Ohio

[73] Assignee: Moen Incorporated, Elyria, Ohio

[21] Appl. No.: 990,016

[22] Filed: Dec. 14, 1992

[51] Int. Cl.[5] ..... F16L 55/18

[52] U.S. Cl. ..... 137/15; 137/315; 137/316; 137/359; 137/801

[58] Field of Search ..... 137/15, 315, 356, 359, 137/801, 316; 4/676, 678

[56] References Cited

U.S. PATENT DOCUMENTS

| | | | |
|---|---|---|---|
| 2,824,312 | 2/1958 | Tortorice . | |
| 3,010,474 | 11/1961 | Moen | 137/359 |
| 3,117,588 | 1/1964 | Billefer | 137/359 |
| 3,190,306 | 6/1965 | Staat et al. | 137/359 |
| 3,427,049 | 2/1969 | Politz | 137/359 |
| 3,782,417 | 1/1974 | Moen | 137/359 |
| 3,785,396 | 1/1974 | Morris et al. | 137/359 |
| 4,356,574 | 11/1982 | Johnson | 137/801 |
| 4,760,861 | 8/1988 | Botnick | 137/801 |
| 4,771,485 | 9/1988 | Traylor | 137/359 |
| 4,848,395 | 7/1989 | Krippendorf | 137/359 |
| 4,852,192 | 8/1989 | Viegener . | |
| 5,010,922 | 4/1991 | Agresta | 137/359 |
| 5,027,851 | 7/1991 | Drees et al. | 137/359 |
| 5,046,521 | 9/1991 | Jensen | 137/360 |

*Primary Examiner*—A. Michael Chambers
*Attorney, Agent, or Firm*—Kinzer, Plyer, Dorn, McEachran & Jambor

[57] ABSTRACT

A two handle faucet and mounting structure has a pair of valve bodies each of which contain a control valve. The valve bodies extend through sink deck openings and are connected by a waterway which is positioned beneath the sink deck. A spout tube is attached to the waterway and extends through a third sink deck opening which is positioned between the other two. A mounting bracket is attached to the waterway and is adapted to be drawn up against the underside of the sink deck by the use of a mounting tool which is inserted into the mounting bracket from above the sink deck. The valve bodies are first positioned through openings in the sink deck and loosely held to the sink deck through the use of mounting members which are positioned in valve body recesses above the sink deck. After the valve bodies have been attached to the sink deck by the mounting members and after the mounting bracket has been drawn up tight against the underside of the sink deck, the spout is positioned on the spout tube and then the mounting tool is inserted through the lift rod opening in the spout to attach the spout to the spout tube and to the top of the sink deck.

13 Claims, 3 Drawing Sheets

TWO HANDLE FAUCET AND MOUNTING STRUCTURE THEREFOR

BACKGROUND OF THE INVENTION

The present invention relates to faucets and in particular to a faucet construction which permits the faucet to be substantially installed from above the sink deck eliminating the difficulties associated with conventional faucet installation in which the fastening members must be attached and turned from below the sink deck, at times requiring the installing plumber to work in extremely cramped quarters. In the present faucet construction and method of installation the faucet body is inserted into preformed holes in the sink deck from beneath the sink deck but thereafter all further installation steps can be done from above, substantially reducing the time and difficulty in installing a faucet. The invention is particularly applicable to what are termed widespread faucet bodies in which there are a pair of control valves, one for hot and one for cold, spaced on either side of a centrally located spout. This construction is applicable to both kitchen faucets and faucets commonly found in the bathroom, referred to as lavatory faucets.

Although there are prior art faucet assemblies which can be installed in part from above the sink deck, none use fastening members which cooperate with the valve bodies extending through openings in the sink deck to temporarily hold the faucet assembly in a position so that it may be permanently fastened, by the use of a tool, from above the sink deck. It is this unique combination of elements and assembly method which distinguishes the present invention from the prior art.

SUMMARY OF THE INVENTION

The present invention relates to faucet assemblies, commonly referred to as widespread valve body assemblies, and in particular to such an assembly which may be installed primarily from above the sink deck.

A primary purpose of the invention is a faucet assembly which may be inserted from beneath a sink deck, temporarily held in place by fastening members or clips installed from above the sink deck, after which the final installation steps may all be completed from above the sink deck.

Another purpose is to provide a simply constructed faucet assembly which may be installed without the necessity of the plumber performing substantial installation steps from beneath the sink deck.

Another purpose is an improved widespread valve body assembly which may be simply and reliably installed from above a faucet sink deck.

Other purposes will appear in the ensuing specification, drawings and claims.

BRIEF DESCRIPTION OF THE DRAWINGS

The invention is illustrated diagrammatically in the following drawings wherein.

DESCRIPTION OF THE PREFERRED EMBODIMENT

Figure 1:
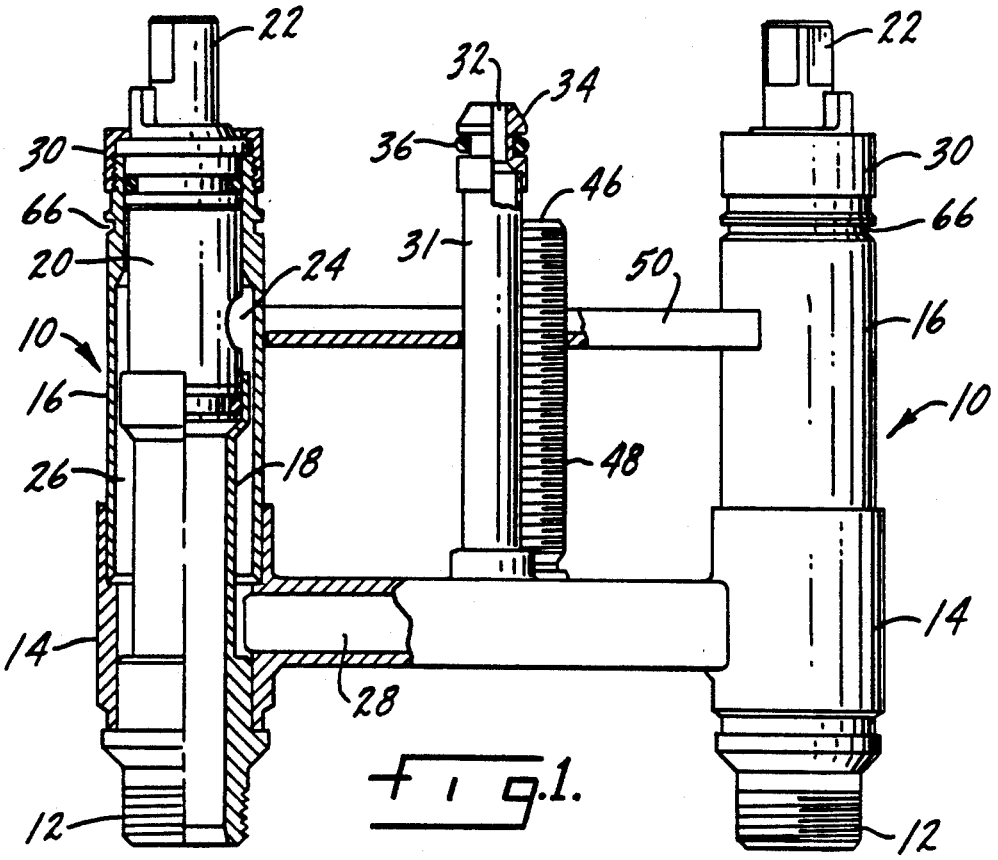
FIG. 1 is a front view, in part section illustrating the faucet assembly of the present invention.
Figure 2:
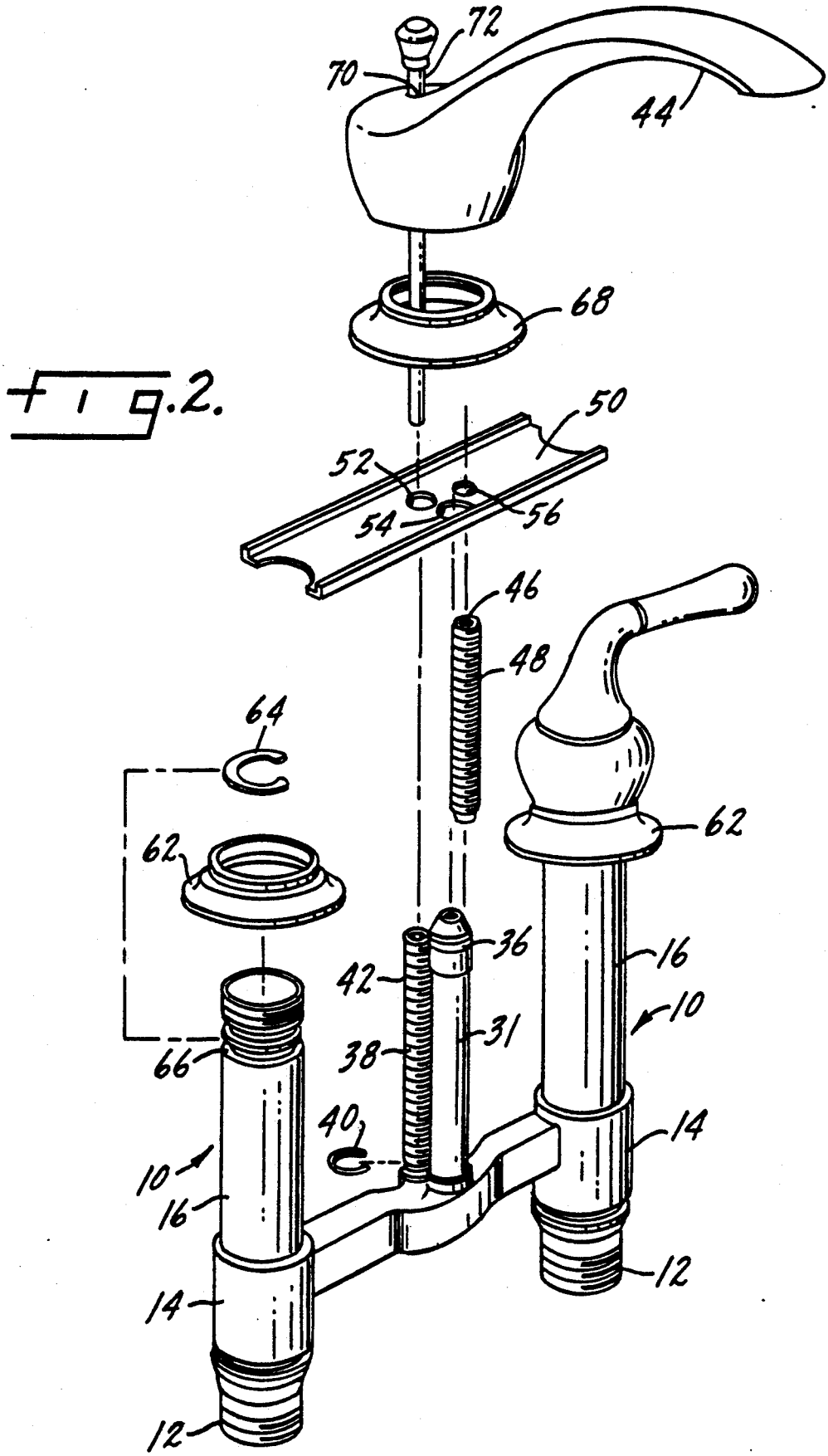
FIG. 2 is an exploded perspective of the faucet assembly of FIG. 1.

As illustrated particularly in FIGS. 1 and 2 the faucet assembly includes a pair of spaced valve bodies indicated at 10, conventional in widespread faucet constructions. Each valve body includes a valve plug 12, a casting 14, which also forms a waterway connecting the valve bodies, and a sleeve 16. The elements 12, 14 and 16 conventionally will be brazed together into a single unit. Each valve plug 12 has a cylindrical extension 18 which extends upwardly within sleeve 16 to support a valve cartridge indicated at 20 which may be of the type shown in U.S. Pat. No. 4,395,018 and sold by the assignee of the present application, Moen Incorporated, under the trademark "1224". Cartridge 20 has a stem 22 which extends upwardly therefrom, and when rotated, this stem will control the volume of water passing through the cartridge. Cartridge 20 has an outlet 24 which opens into a space 26 outside of the cartridge and between the extension 18 and the sleeve 16. Space 26 is in communication with a waterway 28 formed in the casting 14. Thus, the hot and cold water from the cartridges 20, when they are turned for use, will provide both hot and cold water into the waterway 28. Each cartridge 20 is secured in its valve body by means of a cartridge nut 30.

Positioned intermediate the two valve bodies is a spout tube 31 which will be secured at its lower end to casting 14 and which will have an internal waterway 32 so that the mixed hot and cold water from passage 28 may flow to the spout. The upper end of the spout tube has a tapered surface 34 and an adjoining seal ring 36 for use in mounting the spout to the spout tube.

Adjacent to the spout tube is a hollow spout bolt 38 which extends through an opening in casting 14 and is attached to the casting by means of a C-clip 40. This attachment permits the spout bolt to rotate so that its exterior threads 42 function to draw spout 44 down upon the spout tube for permanent installation thereof.

Figure 3:
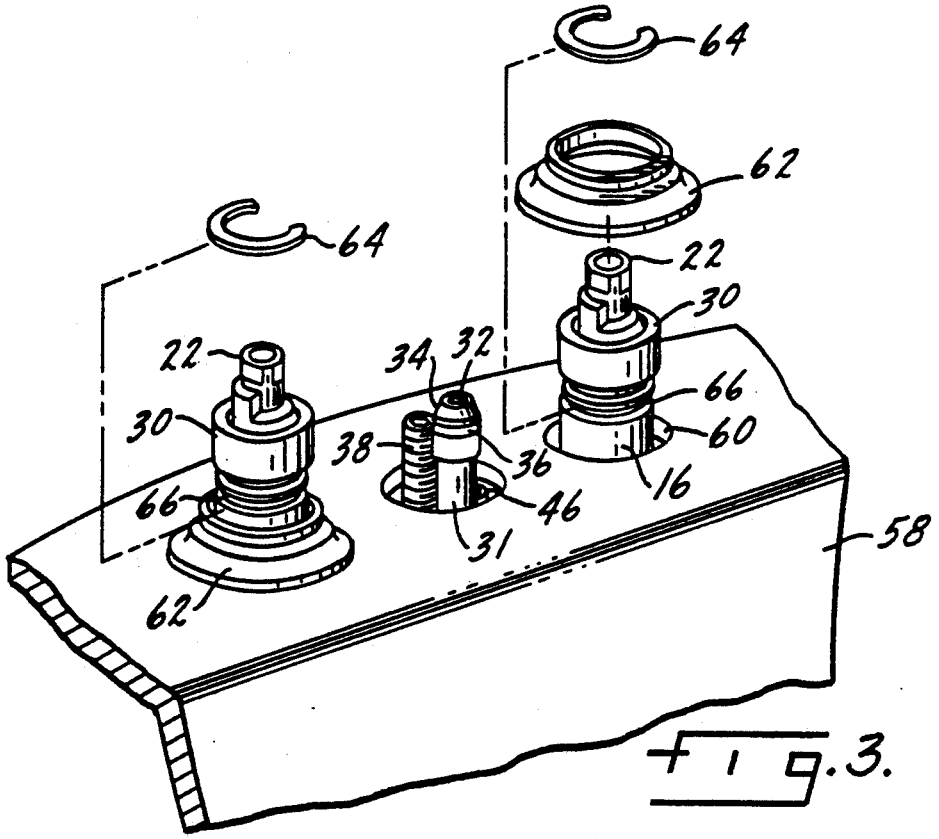
FIG. 3 is a perspective illustrating the first steps in the method of installing the faucet assembly of FIG. 1.

Also positioned adjacent the spout tube is a clamping screw 46 rotatably attached to waterway 14 and having an exterior threaded surface 48, with the clamping screw being threadedly engaged with a mounting bracket 50. The bracket 50 has three holes indicated at 52, 54 and 56. Spout bolt 38 extends up through opening 52, spout tube 31 extends up through opening 54 and clamping screw 46 is threadedly engaged with opening 56. The manner in which the clamping screw and the mounting bracket cooperate to attach the faucet will be described in connection with FIGS. 3, 4 and 5.

The first step in installing the faucet assembly illustrated in FIG. 1 to a conventional sink deck indicated at 58 is to insert the valve bodies 10 through spaced openings 60 in the top of the sink deck. This step is done from beneath the deck and the installing plumber need only hold the faucet assembly with one hand while the valve bodies are inserted into the appropriate openings. Escutcheons, indicated at 62, are then positioned over the valve bodies and C-clips indicated at 64 are then positioned on top of the escutcheons and inserted into grooves 66 on the exterior of sleeves 16. The C-clips 64 will loosely hold the faucet assembly to the top of the sink deck.

Figure 4:
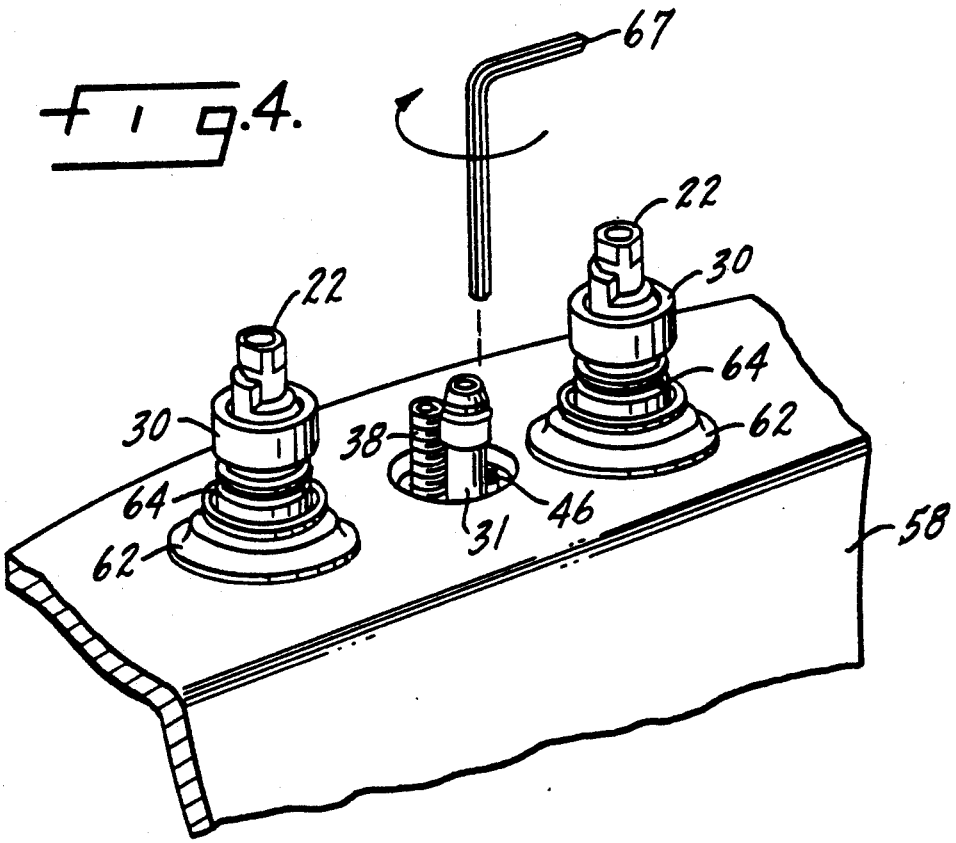
FIG. 4 is a perspective, similar to FIG. 3, illustrating the second step in the method of installing the faucet assembly of FIG. 1.
Figure 5:
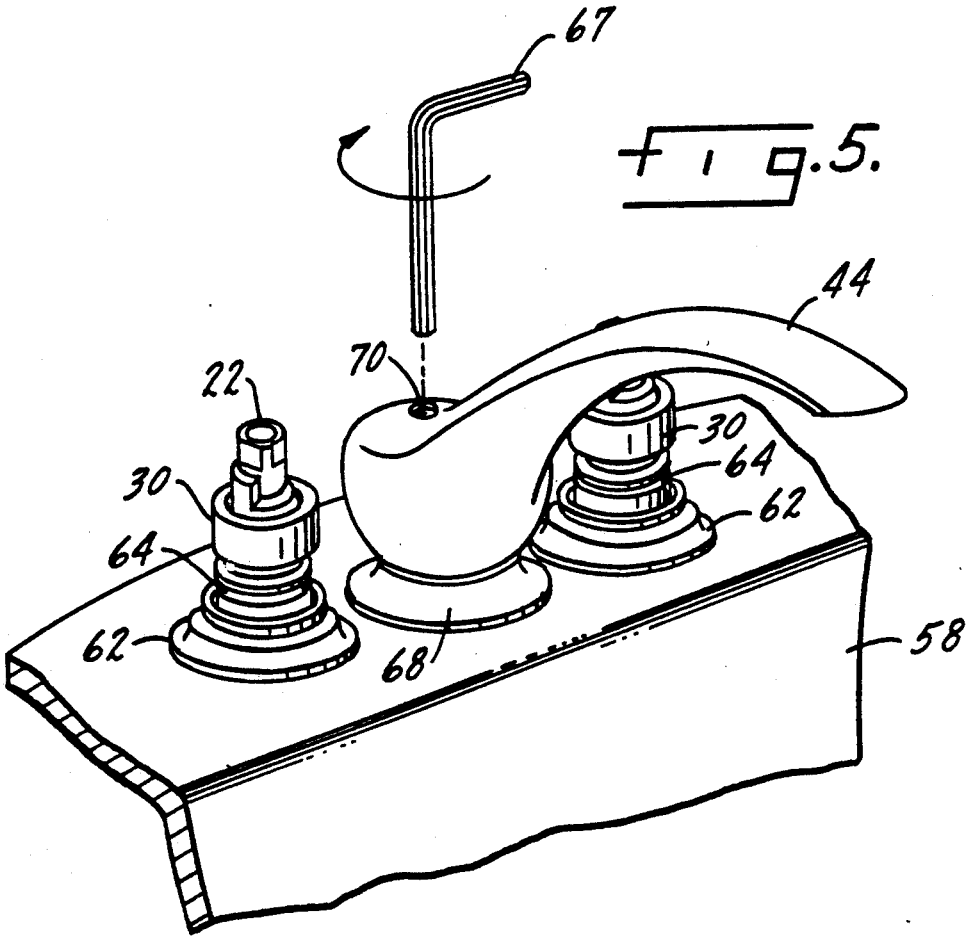
FIG. 5 is a perspective, similar to FIGS. 3 and 4, illustrating the final installation step of the faucet assembly of FIG. 1.

Once the valve assembly has been so positioned, all further installation steps may be done from above the sink deck. Next a hex wrench 67, illustrated in FIG. 4, is inserted, from above the sink deck, into clamping screw 46. As the wrench is turned, the clamping screw will rotate which has the effect of drawing mounting bracket 50 snugly up against the underside of the sink deck. Since the mounting bracket is threaded to clamp screw 46 which is attached to casting 14 the faucet assembly is securely attached to the sink deck.

The next step is to place spout 44 and its associated escutcheon 68 over the spout tube. The hex wrench 67 is then inserted into the lift rod hole 70 of spout 44 as the lift rod hole is in alignment with the spout bolt. Turning hex wrench 67 when so inserted in the lift rod hole 70 has the effect of causing the threaded area 42 on the upper end of the spout bolt to coact with internal threads on the spout to draw the spout firmly down upon the spout tube. This completes installation of the faucet assembly, after which the lift rod 72 can be positioned in the lift rod hole 70, through spout bolt 38 and connected to the drain assembly as is conventional.

Of particular advantage in the invention is the fact that the simply constructed faucet assembly may be essentially installed from above the sink deck, eliminating the necessity of the installing plumber working in the cramped area beneath the sink deck. All that is necessary is to have the faucet assembly in one hand to push the valve bodies up through the sink deck opening, with the plumber using the other hand to place the escutcheons on the valve bodies and then attach the C-clips which loosely fastens the faucet to the sink deck. The assembly method is simple, reliable, and substantially labor saving for the installing plumber.

Whereas the preferred form of the invention has been shown and described herein, it should be realized that there may be many modifications, substitutions, and alterations thereto.

The embodiments of the invention in which an exclusive property or privilege is claimed are defined as follows:

1. A method of installing to a sink deck a faucet having a pair of attached and spaced valve bodies, an intermediate spout tube attached to the valve bodies, mounting bracket attached to the valve bodies, and a spout positionable on the end of the spout tube, said method including the steps of inserting the valve bodies through spaced sink deck openings from beneath the sink deck, positioning mounting members in cooperating valve body recesses above the sink deck to hold the valve bodies to the sink deck, inserting a mounting tool into the mounting bracket through a sink deck opening and from above the sink deck, using the mounting tool to draw the mounting bracket firm against the sink deck underside, positioning the spout onto the spout tube, and inserting a mounting tool through the top of the spout to secure the spout to the spout tube and sink deck.

2. The method of claim 1 further characterized in that the same mounting tool is used to secure the mounting bracket to the underside of the sink deck and to secure the spout to the spout tube and sink deck.

3. The method of claim 1 further characterized in that the spout has a lift rod opening, with the mounting tool for for attaching the spout being inserted through the lift rod opening.

4. The method of claim 1 further characterized by and including the step of placing escutcheons about the valve bodies prior to placing the mounting members in the valve body recesses.

5. The method of claim 1 further characterized in that said mounting tools rotate in drawing the mounting bracket firm against the sink deck underside and in attaching the spout to the spout tube and sink deck.

6. A two handle faucet and mounting structure for mounting the faucet to a sink deck having a plurality of openings therein, including a pair of valve bodies each of which contain a control valve therein and each of which are formed and adapted to extend through a sink deck opening, a mounting member for each valve body, with each mounting member cooperating with a portion of the valve body that extends above the sink deck for holding the faucet to the sink deck, a waterway connecting said valve bodies, a spout tube attached to said waterway and extending through a sink deck opening, said valve bodies and waterway defining a water flow path from said control valves to said spout tube, a mounting bracket, a clamping screw attached to said waterway and in threaded engagement with said mounting bracket and accessible from above the sink deck, with rotation of said clamping screw moving said mounting bracket toward the underside of the sink deck for securing the faucet thereto, a spout for attachment to the upper end of said spout tube, a spout bolt attached to said waterway and extending through an opening in the sink deck and accessible from above the spout, with rotation of the spout bolt from above said spout pulling the spout down upon the spout tube and the sink deck.

7. The faucet of claim 6 further characterized in that each of said valve bodies have a peripheral groove in that portion of the valve body which extends above the sink deck, with said mounting members being positionable in said grooves to thereby loosely hold the faucet to the sink deck.

8. The faucet of claim 7 further characterized in that each of said mounting members are C-shaped clips.

9. The faucet of claim 7 further characterized by and including an escutcheon positioned on top of the sink deck and about each valve body, said valve body grooves being above the escutcheon to receive the mounting members therein.

10. The faucet of claim 6 further characterized in that the sink deck has three openings, one each for the valve bodies, with the spout tube, spout bolt and clamping screw being accessible through the third opening.

11. The faucet of claim 6 further characterized in that said mounting bracket has a plurality of openings, one for the spout tube, one for the spout bolt, and one for the clamping screw.

12. The faucet of claim 11 further characterized in that said spout bolt is attached to said waterway for rotation relative thereto.

13. The faucet of claim 6 further characterized in that said spout has a lift rod opening therein, with said spout bolt being accessible from above the spout through the lift rod opening.

* * * * *